US006179336B1

(12) United States Patent
Peterson

(10) Patent No.: US 6,179,336 B1
(45) Date of Patent: Jan. 30, 2001

(54) PRESSURE SEAL POCKET BUSINESS FORM PRODUCTION

(75) Inventor: Wayne C. Peterson, Manchester, NH (US)

(73) Assignee: Moore North America, Inc., Grand Island, NY (US)

( * ) Notice: Under 35 U.S.C. 154(b), the term of this patent shall be extended for 0 days.

(21) Appl. No.: 09/480,158

(22) Filed: Jan. 10, 2000

(51) Int. Cl.[7] ..... B42D 15/00

(52) U.S. Cl. ..... 283/62; 283/61; 283/101; 281/2; 281/12; 281/3.1

(58) Field of Search ..... 281/2, 31, 3.1, 281/5, 9, 12, 13; 283/61, 62, 101; 270/52.02

(56) References Cited

U.S. PATENT DOCUMENTS

| | | | | |
|---|---|---|---|---|
| 3,592,381 | | 7/1971 | Brody . | |
| 4,733,817 | | 3/1988 | Makowka . | |
| 5,193,850 | * | 3/1993 | Lombardo | 381/2 |
| 5,230,464 | | 7/1993 | Schluger . | |
| 5,238,178 | * | 8/1993 | Hutchingson et al. | 229/92.1 |
| 5,253,798 | * | 10/1993 | Lombardo | 229/92.1 |
| 5,318,324 | | 6/1994 | Lombardo et al. . | |
| 5,361,897 | | 11/1994 | Poehler . | |
| 5,427,640 | | 6/1995 | Daniels . | |
| 5,607,100 | | 3/1997 | Stenner . | |

* cited by examiner

*Primary Examiner*—Willmon Fridie, Jr.
(74) *Attorney, Agent, or Firm*—Nixon & Vanderhye PC

(57) ABSTRACT

A pocket containing business form, an intermediate for producing the form, and method of producing the business form, provide optimum securement of the panels of the form together with adhesive by providing the adhesive at and along the side edges rather than merely adjacent the side edges. The form may be produced from a web or sheet by moving it in a first direction, applying adhesive patterns (preferably pressure activated cohesive) to the web or sheet along the first direction adjacent but spaced from first and second side edges and at and along a plurality of centerlines between the side edges, and slitting or cutting the web or sheet along the first direction at the adhesive patterns so that adhesive is provided on both sides of each cut or slit, to provide a plurality of forms (e.g. four forms) with form side edges having adhesive at and along the form side edges. If in a web configuration the web is ultimately formed into a sheet, and the sheet is folded (e.g. eccentrically Z-folded) to form a pocket and the form is sealed in the folded configuration by activating the adhesive.

21 Claims, 6 Drawing Sheets

PRESSURE SEAL POCKET BUSINESS FORM PRODUCTION

BACKGROUND AND SUMMARY OF THE INVENTION

U.S. Pat. No. 5,318,324 (the disclosure of which is hereby incorporated by reference herein) shows an advantageous method for producing a business form, an intermediate for producing the business form, and a pocket containing business form so produced, that are particularly advantageous for a wide variety of purposes including as a library envelope to be inserted inside of a book. While the products and method described therein are highly advantageous, it has been found that in order to provide optimum sealing that it is necessary to provide the adhesive and along the side edges, rather than merely adjacent the side edges, of the form, and in order to provide the most cost effective arrangement and method the form should be produced more than two across, preferably four across. Also, the business form according to the present invention, in addition to acting as a library card holder, can function as a personal ID visitor pass for trade shows, and include an RFID label, can be a hotel pass key envelope, can function as a "shelf talker" in retail sales by providing adhesive on the back, may be utilized as a personalized pocket protector, or may be provided as a job ticket with variable information.

According to one aspect of the present invention there is provided a method of producing a business form utilizing a paper like sheet or web having a predetermined width and first and second side edges, comprising: (a) Moving the web or sheet in a first direction. (b) Applying adhesive patterns to the web or sheet along the first direction adjacent but spaced from the first and second side edges, and at and along a plurality of centerlines between the first and second edges. (c) Slitting or cutting the web or sheet along the first direction at the adhesive patterns adjacent the first and second side edges and at the plurality of centerlines so that adhesive is provided on both sides of each cut or slit and to provide a plurality of forms with form side edges having adhesive at and along the form side edges. (d) If in web configuration, forming the web into a sheet. (e) Folding a sheet defining at least one form along at least one fold line substantially perpendicular to the form side edges. And (f) sealing the at least one form in folded configuration by activating the adhesive.

In the practice of the method preferably (b) is practiced by applying pressure activated cohesive, and then (f) is practiced by automatically applying pressure of at least 100 pounds per lineal inch to the forms to effect sealing. Also (f) may be practiced by steam roller sealing, rather than requiring edge rollers for sealing only at the pressure activated cohesive. The method procedures may be practiced in a wide variety of sequences as long as the desired end results are provided. Typically, however, (d), (e) and (f) are practiced prior to (c).

In a preferred embodiment (b) or (c) are practiced to provide a four forms wide web or sheet, and (c) is practiced by guillotine cutting. The method also preferably comprises imaging indicia on the web or sheet prior to (c), which may be variable indicia or non-variable indicia. When a pocket business form is to be provided, preferably (e) is practice to eccentrically Z-fold the forms about two parallel fold lines, and (b) and (e) are practiced to form a pocket.

According to another aspect of the present invention a pocket containing business form is provided comprising the following components: A single sheet of paper like material, comprising a first panel having a first length and a first width, and first and second face. A second panel having a second length and the first width, the second length being less than one half the first length, and having first and second faces which are continuous of the first and second faces of the panel. A first fold line between the first and second panels extending widthwise of the panels, the second panel folded about the first fold line so that the first face of the second panel comes into contact with the first face of the first panel, the first panel having a free portion not covered by the second panel. Indicia imaged on the free portion of the first panel. Adhesive connecting the first face of the second panel to the first face of the first panel to form a pocket capable of receiving an index card. A third panel having the second length and the first width, and having first and second faces which are continuations of the first and second faces of the first and second panels. A second fold line between the second and third panels extending widthwise of the panels, the third panel folded about the second fold line so that the second face of the third panel comes into contact with the second face of the second panel. Adhesive connecting the second faces of the second and third panels together so that they both cooperate with the first panel to form the pocket. And the sheet having side edges defining the widths of the panels, and the adhesive defined at and along the side edges for optimum securement of the panels together by the adhesive.

The adhesive connecting the panels together may further comprise adhesive adjacent the first fold line, and also adhesive adjacent the second line. Preferably the adhesive comprises pressure activated cohesive such as disclosed in U.S. Pat. No. 5,201,464 and the art referenced therein, including U.S. Pat. No. 4,918,128. The patterns may comprise any configuration such as lines, spots, dots, bars, strips (discontinuous or continuous), or any other suitable configuration. Spaced bars or strips are preferred in the exemplary embodiment illustrated in the drawings.

The indicia may comprise indicia indicating the due date of a library book and the pocket containing business form may be in combination with a library book with the second face of the first panel affixed to the inside cover portion of the library book with adhesive. Alternatively the indicia may be that useful for the pocket business form to function as a personal ID visitor pass, such as for trade shows or businesses, a hotel passkey envelope, a shelf talker (with adhesive on the backer), for retail stores a personalized pocket protector, or a job ticket envelope with variable information.

According to another aspect of the present invention there is provided a business form intermediate comprising a sheet of paperlike material having first and second faces a rectangular configuration [and e.g. a length of about 11 inches], top and bottom edges, side edges, and at least one centerline between the side edges. A first fold line extending parallel to the top and bottom edges [e.g. and about 6¼ inches from the top edge]. A second fold line extending parallel to the top and bottom edges [e.g. and about 2⅜ inches from the first fold line and the bottom edge]. The first fold line defining a first panel between the top edge and the first fold line, and the second fold line defining a second panel between the first and second fold lines, and a third panel between the second fold line and the bottom edge. Cooperating adhesive patterns disposed on the first face of the first panel adjacent the fold line, and on the first face of the second panel, including adjacent the side edges and the centerlines. And cooperating adhesive patterns disposed on the second faces of the second and third panels, including at and along the side edges and the centerlines for optimum securement of the panels by the adhesive.

In the business form intermediate described above the adhesive patterns may further include adhesive patterns adjacent the bottom edge. Preferably the sheet has three (or more) centerlines with adhesive disposed at and along all of the centerlines. Also, indicia is typically imaged on the first panel first face, either variable or non-variable indicia. As described above the adhesive preferably comprises pressure activated cohesive.

It is the primary object of the present invention to provide a simple and cost effective method for making a pocket containing business form having optimum sealing at the pocket, and to provide a pocket containing business form and a business form intermediate for making the business form. This and other objects of the invention will become clear from a detailed description of the invention and from the appended claims.

DETAILED DESCRIPTION OF THE DRAWINGS

Figure 1:
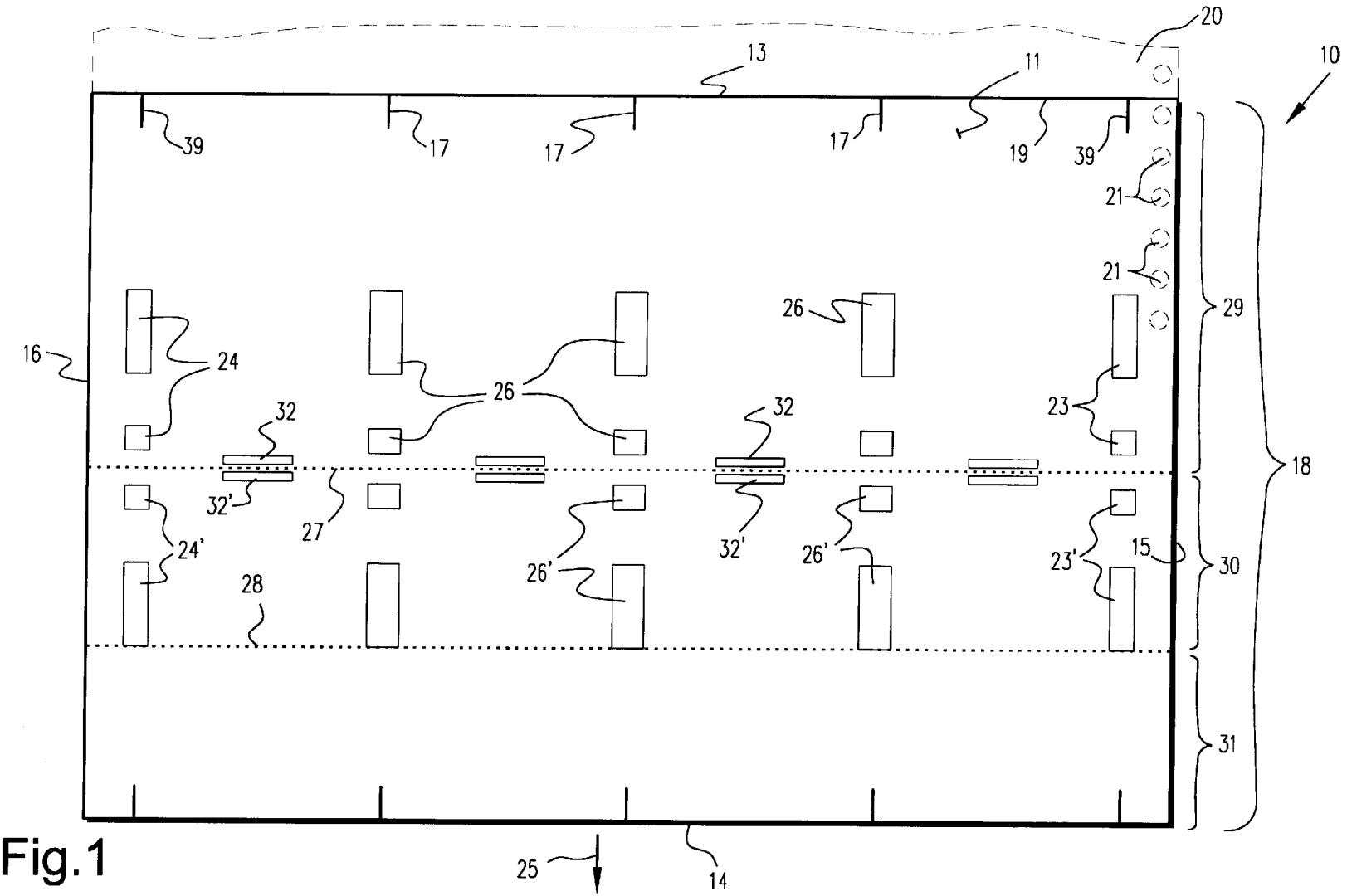
FIG. 1 is a top plan view of a first face of an exemplary business form intermediate according to the present invention.
Figure 2:
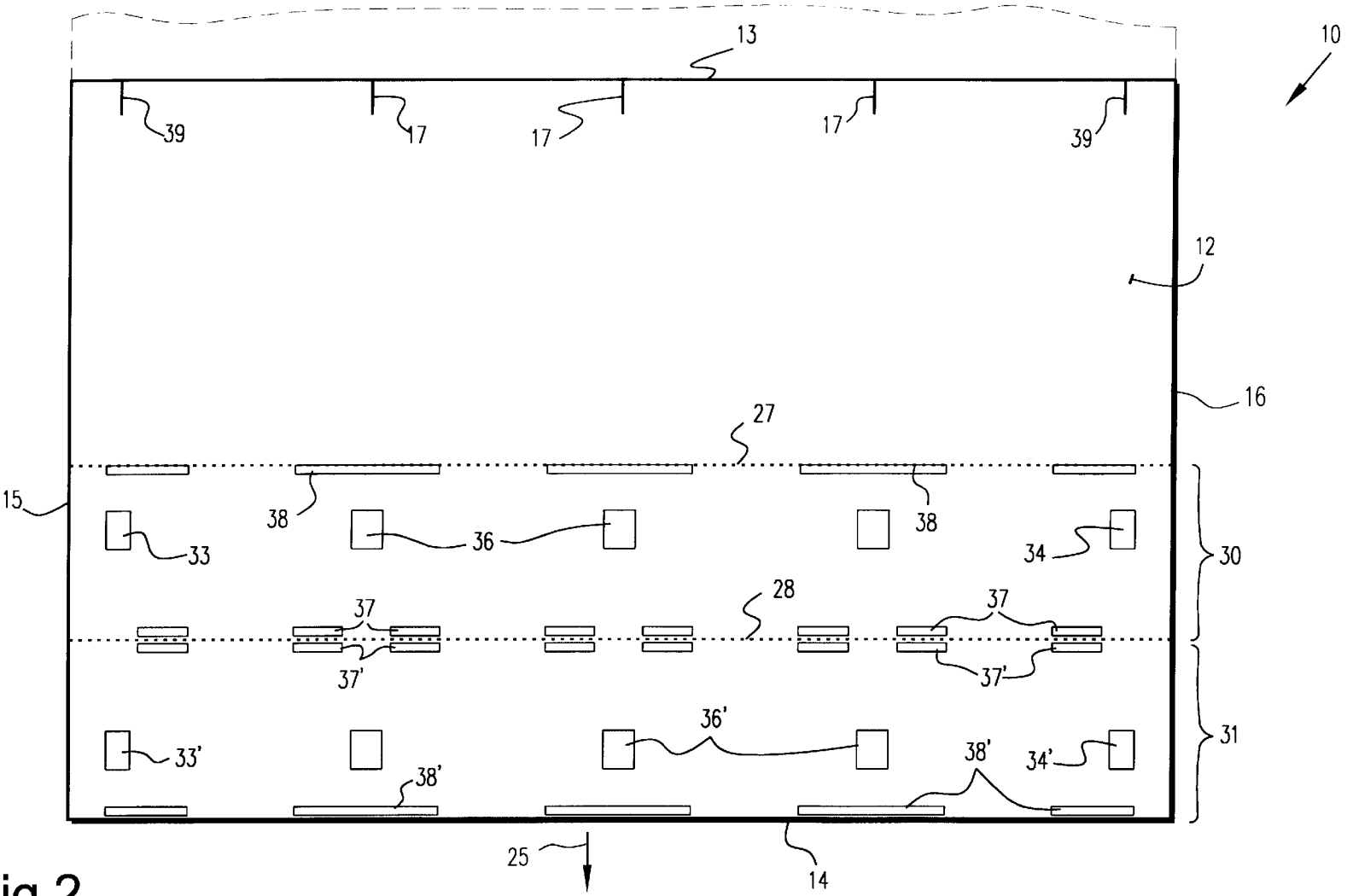
FIG. 2 is a top plan view of the opposite face of the business form of FIG. 1.

An intermediate for a pocket containing business form according to the present invention is shown generally by reference numeral 10 in FIGS. 1 and 2. The intermediate 10 comprises, preferably, a single sheet of material, preferably paperlike material such as bond paper, light paperboard, card stock, manila folder stock, or the like. One particularly advantageous paperlike material that may be utilized is PMS-461 brown, which is solid and gives the effect of manila paper. However, a wide variety of materials may be utilized.

The sheet has a first (front) face 11 (see FIG. 1) and a second (back) face 12 (see FIG. 2). It includes a top edge 13, a bottom edge 14, side edges 15, 16 and at least one centerline which is disposed between the side edges 15, 16 and substantially parallel thereto. In the preferred embodiment illustrated in FIGS. 1 and 2 three such centerlines (17) are provided since the intermediate of FIGS. 1 and 2 is used to produce four substantially identical forms, and individual intermediates for forming such business forms. The centerlines 17, as illustrated in FIGS. 1 and 2, may actually be partial ink lines as shown, or full ink or score lines, or may simply be imaginary lines.

The intermediate 10 illustrated in FIGS. 1 and 2 is shown as a sheet, indicated schematically by 18 in FIG. 1, but it is to be understood that the intermediate 10 may be part of a web, being connected, for example, along the line of weakness 19, to an entire web 20 of like intermediates 10, or intermediates 10 to be produced. Ultimately the intermediates 10 of the web 20 may be burst along the lines of weakness 19 (such as perforation lines) or cut into individual sheets 18, etc. To facilitate processing the sheet 18 or web 20 may have conventional tractor drive openings shown in dotted line at 21 in FIG. 1. While the tractor drive openings are shown only along the edge 15 in FIG. 1, it is to be understood that they may be provided along both edges 15, 16 and are ultimately cut from the final product after processing.

The intermediate 10 of FIGS. 1 and 2 comprises a plurality of adhesive patterns such as the adhesive patterns 23, 24 parallel to the direction of movement 25 of the sheet 18 or web 20 during processing and adjacent but spaced from the side edges 15, 16, as well as the patterns 26 straddling the centerlines 17. The direction of movement 25 is substantially perpendicular to the top and bottom edges 13, 14 and substantially parallel to the side edges 15, 16. The first and second fold lines 27, 28, respectively, are provided in the intermediate 10 parallel to the edges 13, 14. The fold lines 27, 28 may be score lines, perforation lines, or any other lines facilitating folding. As seen in FIG. 1, the adhesive patterns 23, 24, 26 are provided in a first panel 29 between the first fold line and the top edge 13. Patterns 23', 24' and 26' for cooperating with the patterns 23, 24, and 26 are preferably provided in the second panel 30 between the first and second fold lines 27, 28 while the third panel 31, between the second fold line 28 and the bottom edge 14, has no adhesive patterns on the first face 11 thereof.

In the preferred embodiment illustrated in FIG. 1, adhesive patterns 32, 32' are provided straddling the first fold line 27.

FIG. 2 also shows other adhesive patterns provided on the second face 12 of the intermediate 10. The patterns 33, 33' which cooperate with each other, are on opposite sides of the second fold line 28 in the panels 30, 31, respectively, and spaced substantially the same distance from the side edge 15 as the patterns 23, 23' are; patterns 34, 34' are spaced substantially the same distance from the side edge 16 as the patterns 24, 24'; and the "centerline" adhesive patterns 36, 36' straddle the centerlines 17. The face 12 also preferably comprises the adhesive patterns 37, 37' which cooperate with each other and straddle the second fold line 28, and the adhesive patterns 38, 38', which cooperate with each other and which are immediately adjacent or along the second fold line 27 in the bottom edge 14.

All of the adhesive patterns described (e.g. 23, 23', 24, 24', 26, 26', 32, 32', 33, 33', 34, 34', 36, 36', 37, 37', and 38, 38') are preferably pressure activated cohesive such as described in U.S. Pat. Nos. 4,918,182 and 5,201,464.

Figure 3:
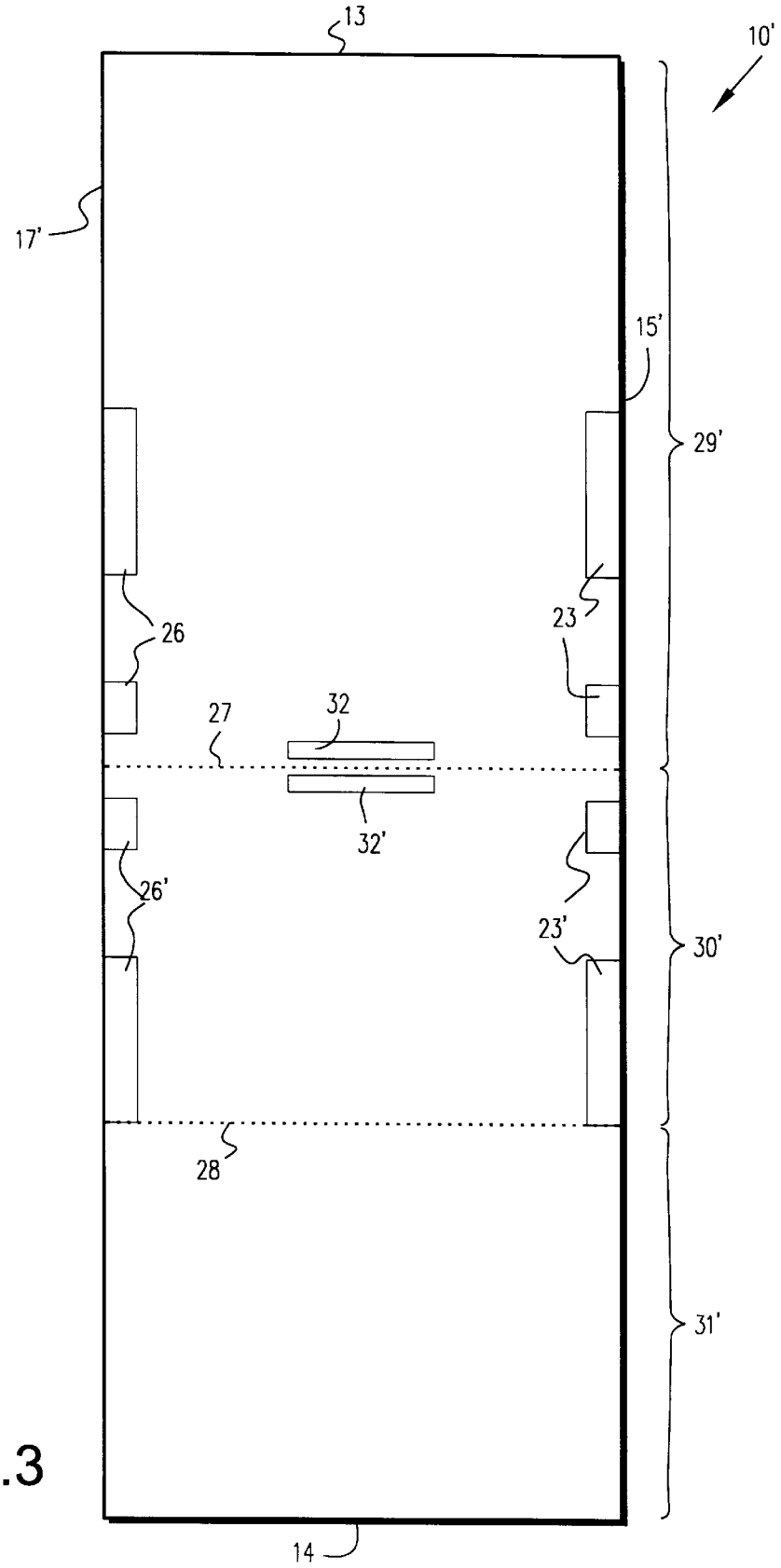
FIG. 3 is a top plan view of an individual business form separated from the business form construction of FIGS. 1 and 2, showing the first face thereof.
Figure 4:
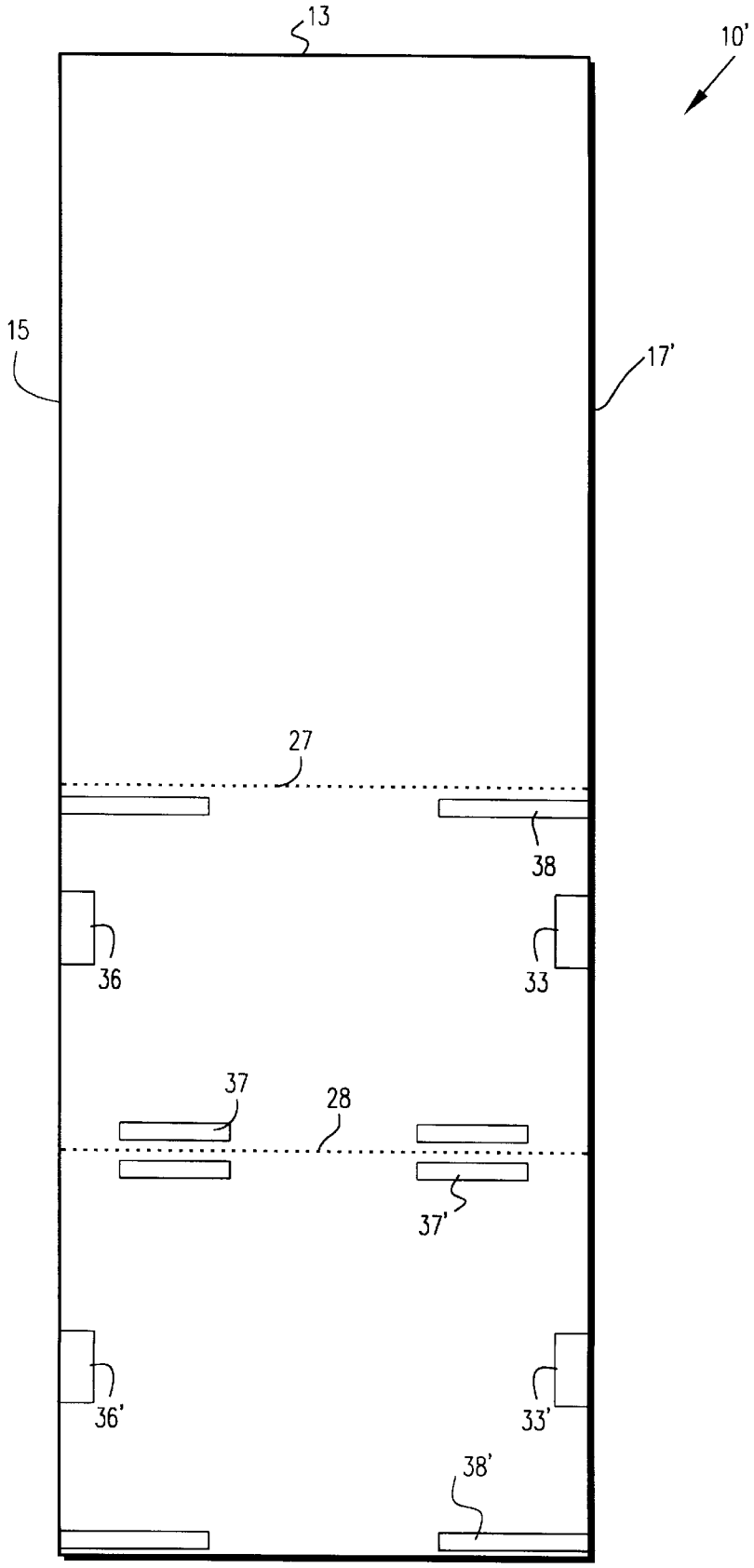
FIG. 4 is a view like that of FIG. 3 only the opposite face.

During processing of the intermediates 10 ultimately the intermediates 10 are slit or cut (e.g. guillotine cut) along the centerlines 17 and along the lines 39 spaced from the side edges 15,16 and passing through the cohesive patterns 23, 24, 33, 34. Depending upon the exact procedure during processing the intermediate 10' illustrated in FIGS. 3 and 4, which comprises one individual intermediate from the collective intermediate 10, may be produced. The intermediate 10' of FIGS. 3 and 4 is shown as the individual intermediate formed from closest to the side edge 15 of the intermediate 10 having the side edges 15' and 17' thereof formed at the lines 17, 39 illustrated in FIG. 1.

Figure 5:
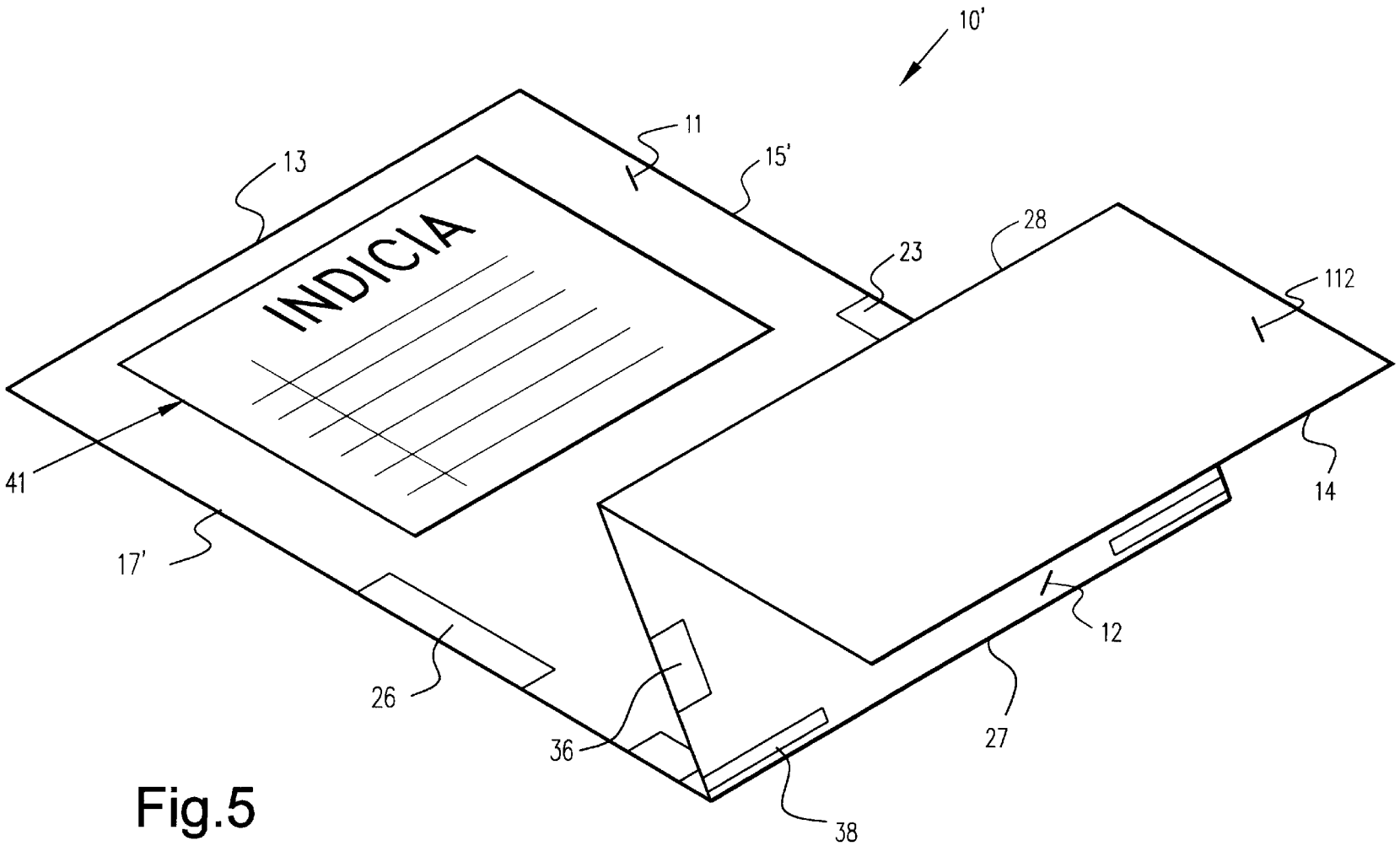
FIG. 5 is schematic perspective view showing the form of FIGS. 3 and 4 being eccentrically Z-folded to form a pocket business form according to the invention.
Figure 6:
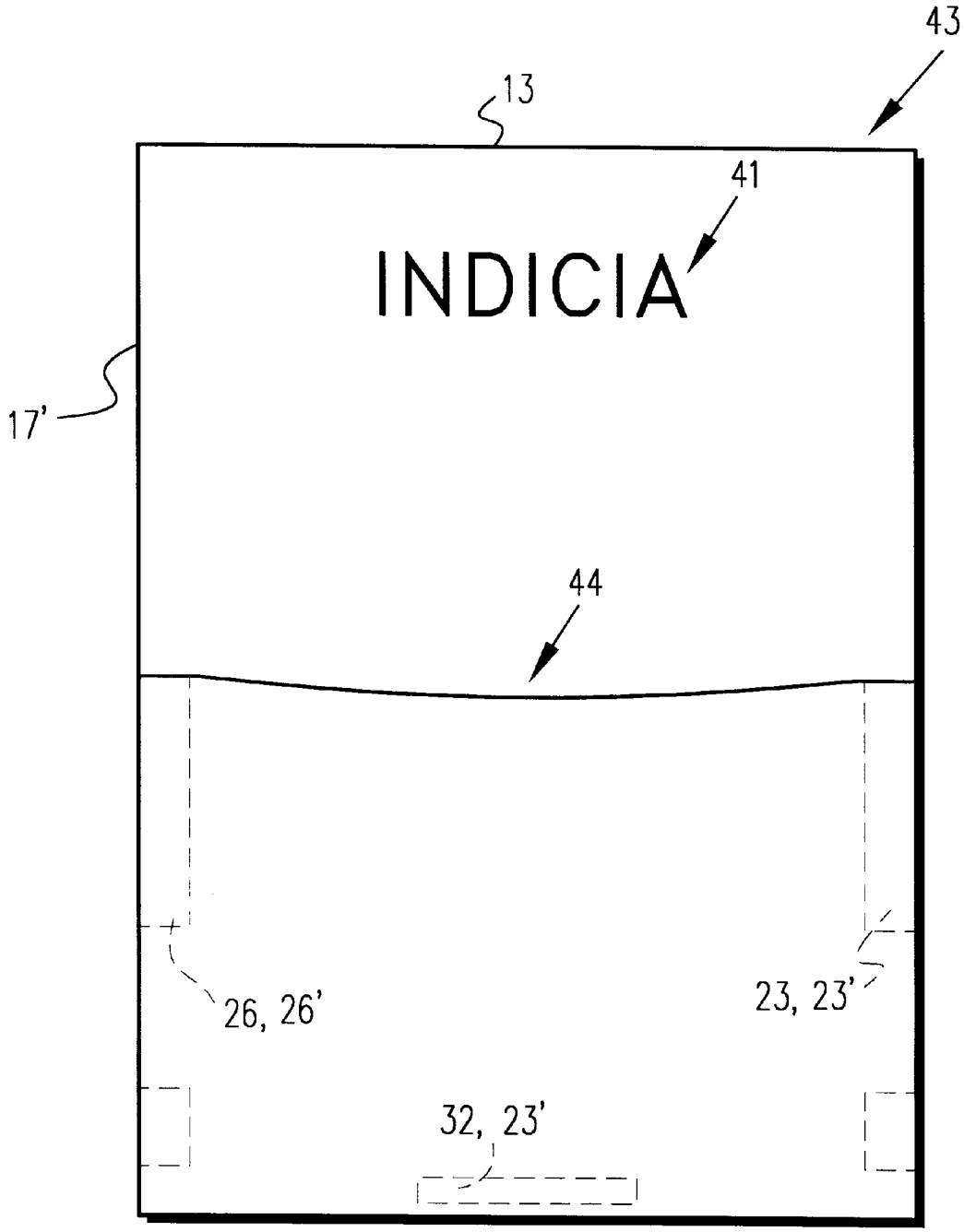
FIG. 6 is a front view showing an exemplary pocket business form according to the invention with the adhesive shown in dotted line and with the pocket flap shown distended for clarity of illustration.

FIG. 5 shows an intermediate 10', which has had indicia 41 imaged on the first panel 29' first face. The indicia 41 is shown on the exemplary embodiment of FIG. 5 as being library book due date indicia, but it can be any suitable variable of non-variable indicia depending upon the ultimate use to which the business form 43 (see FIG. 6) produced from the intermediate 10' may be put. The business form 43 is formed by folding the intermediate 10' about the fold lines 27, 28 in the manner illustrated in FIG. 5 (that is eccentrically Z-folding), and then passing the intermediate 10' through a conventional pressure sealer which applies (if the adhesive utilized is pressure sensitive cohesive) at least about 100 pounds per lineal inch of force so as to seal the adhesive patterns to each other, namely the patterns 23 to the patterns 23', the patterns 26 to the patterns 26', the patterns 32 to the patterns 32', 33 to 33', 36 to 36', 37 to 37' and 38 to 38'. As will be seen, all of the adhesive patterns adjacent the edges 15', 17' are at and along those edges so as to provide optimum sealing of each of the plurality (four in the exemplary embodiment illustrated) of the intermediates 10' that are produced from each intermediate 10. Thus, a very cost effective construction and procedure are also provided.

The intermediates 10' may never be actually formed, however, during construction. For example, the intermediates 10 of FIGS. 1 and 2 can be folded about the fold lines 27, 28 and then passed through a sealer to seal all of the adhesive portions, and only after that sealing would guillotine cutting or slitting take place along the lines 17, 39 to produce the final business forms 43 each having a pocket 44 therein. The pocket 44 may be dimensioned so as to receive an index card for a library book, an ID visitor pass, a hotel passkey, an advertising item for use with a shelf talker (the pocket or business form 43 forming a shelf talker when adhesive is provided on the back 12 thereof), or a job ticket, or the business form 43 may be dimensioned to fit in a shirt or pants pocket to comprise a pocket protector and for receipt of a pen or pencil clip therein, or the like.

In the method of construction of the business form 43 the web or sheet 18, 20 is moved in the direction 25, and adhesive patterns 23, 24, 26, etc. are applied along the first direction adjacent but spaced from the first and second side edges 15,16 and at and along a plurality of centerlines 17 (straddling the centerline). If the construction is a web construction, ultimately the web is formed into a sheet 18, as by bursting along the lines of weakness 19, cutting, or the like, and either before or after slitting or cutting the web along the first direction 25 at the adhesive patterns 23, 24 and the centerlines 17, etc., the sheet 18 (or intermediate 10') is folded to define at least one form 43, along at least one fold line 27, substantially perpendicular to the form side edges (e.g. 15,16 or 15', 17') and sealing at least one form in folded configuration by activating the adhesive patterns 23, 24, 26, etc. Preferably the method also comprises imaging indicia 41 on the web or sheet 20, 18, respectively, prior to slitting or guillotine cutting into individual forms or form intermediates, and typically folding is practiced to eccentrically Z-fold the form about two parallel fold lines, and to form a pocket 44.

It will thus be seen that according to the present invention a pocket type business form, an intermediate for production of the form, and a method of production thereof, are disclosed which provide optimum sealing of the form along edges, and in a very cost effective and simple manner. While the invention has been herein disclosed and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A pocket containing business form comprising:

a single sheet of paper, comprising a first panel having a first length and a first width, and first and second faces;

a second panel having a second length and said first width, said second length being less than one half said first length, and having first and second faces which are continuous of the first and second faces of said first panel;

a first fold line between said first and second panels extending widthwise of said panels, said second panel folded about said first fold line so that said first face of said second panel comes into contact with said first face of said first panel, said first panel having a free portion not covered by said second panel;

indicia imaged on said free portion of said first panel;

adhesive connecting said first face of said second panel to said first face of said first panel to form a pocket capable of receiving an index card;

a third panel having said second length and said first width, and having first and second faces which are continuations of the first and second faces of said first and second panels; a second fold line between said second and third panels extending widthwise of said panels, said third panel folded about said second fold line so that said second face of said third panel comes into contact with said second face of said second panel;

adhesive connecting said second faces of said second and third panels together so that they both cooperate with said first panel to form said pocket; and said sheet having side edges defining the widths of said panels, and said adhesive defined at and along said side edges for optimum securement of said panels together by said adhesive.

2. A pocket as recited in claim 1 wherein said adhesive connecting said panels together further comprises adhesive adjacent said first fold line.

3. A pocket as recited in claim 2 wherein said adhesive connecting said panels together further comprises adhesive adjacent said second fold line.

4. A pocket as recited in claim 3 wherein said adhesive comprises pressure activated cohesive.

5. A pocket as recited in claim 1 wherein said adhesive comprises pressure activated cohesive.

6. A pocket containing business form as recited in claim 1 wherein said indicia comprises indicia indicating a due date of a library book.

7. A pocket containing business form as recited in claim 6 in combination with a library book, said second face of said first panel affixed to an inside cover portion of said library book with adhesive.

8. A business form intermediate comprising a sheet of paper having first and second faces a rectangular configuration, top and bottom edges, side edges, and at least one centerline between said side edges;

a first fold line extending parallel to said top and bottom edges and spaced from said top edge;

a second fold line extending parallel to said top and bottom edges and spaced from said first fold line and said bottom edge;

said first fold line defining a first panel between said top edge and said first fold line, and said second fold line defining a second panel between said first and second fold lines, and a third panel between said second fold line and said bottom edge;

cooperating adhesive patterns disposed on said first face of said first panel adjacent said fold line, and on said first face of said second panel, including adjacent said side edges and said at least one centerline; and cooperating adhesive patterns disposed on said second faces of said second and third panels, including at and along said side edges and said at least one centerline for optimum securement of said panels together by said adhesive.

9. A business form intermediate as recited in claim 8 wherein said adhesive patterns further include adhesive patterns adjacent said bottom edge.

10. A business form intermediate as recited in claim 9 wherein said adhesive comprises pressure activated cohesive.

11. A business form intermediate as recited in claim 8 wherein said sheet has three centerlines and adhesive disposed at and along all of said centerlines.

12. A business form intermediate as recited in claim 11 wherein said adhesive comprises pressure activated cohesive.

13. A business form intermediate as recited in claim 11 further comprising indicia imaged on said first panel first face.

14. A business form intermediate as recited in claim 8 wherein said adhesive comprises pressure activated cohesive.

15. A business form intermediate as recited in claim 8 wherein said adhesive comprises pressure activated cohesive.

16. A business form intermediate as recited in claim 9 wherein said sheet has three centerlines and adhesive disposed at and along all of said centerlines.

17. A pocket as recited in claim 1 wherein said adhesive connecting said panels together further comprises adhesive adjacent said second fold line.

18. A pocket as recited in claim 17 wherein said adhesive comprises pressure activated cohesive.

19. A business form as recited in claim 8 further comprising adhesive adjacent said first fold line for connecting said panels together.

20. A business form as recited in claim 19 further comprising adhesive adjacent said second fold line for connecting said panels together.

21. A pocket as recited in claim 20 wherein said adhesive comprises pressure activated cohesive.

* * * * *